US008454137B2

(12) United States Patent
Price et al.

(10) Patent No.: US 8,454,137 B2
(45) Date of Patent: Jun. 4, 2013

(54) BIASED WALL INK TANK WITH CAPILLARY BREATHER

(75) Inventors: Brian G. Price, Pittsford, NY (US); James Edward Pickering, Bloomfield, NY (US); Joseph W. Hoff, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 93 days.

(21) Appl. No.: 12/974,025

(22) Filed: Dec. 21, 2010

(65) Prior Publication Data

US 2012/0154491 A1 Jun. 21, 2012

(51) Int. Cl.
*B41J 2/175* (2006.01)
*B41J 2/17* (2006.01)

(52) U.S. Cl.
USPC ..... 347/85; 347/84; 347/86

(58) Field of Classification Search
USPC ..... 347/84, 85, 86
See application file for complete search history.

(56) References Cited

U.S. PATENT DOCUMENTS

| | | | | |
|---|---|---|---|---|
| 5,280,300 | A | 1/1994 | Fong et al. | |
| 5,409,134 | A | 4/1995 | Cowger et al. | |
| 5,754,207 | A | 5/1998 | Gragg et al. | |
| 6,186,620 | B1 | 2/2001 | Hsieh et al. | |
| 6,428,153 | B1 | 8/2002 | Hsu et al. | |
| 6,450,630 | B2 * | 9/2002 | Kanaya et al. | 347/86 |
| 6,773,099 | B2 | 8/2004 | Inoue et al. | |
| 6,830,324 | B2 | 12/2004 | Ogura et al. | |
| 7,086,725 | B2 | 8/2006 | Ogura et al. | |
| 2001/0012039 | A1 | 8/2001 | Kanaya et al. | |
| 2003/0122909 | A1 | 7/2003 | Ogura et al. | |
| 2007/0188529 | A1 | 8/2007 | Zhang | |
| 2008/0239037 | A1 | 10/2008 | Inoue et al. | |
| 2009/0309940 | A1 | 12/2009 | Price | |

FOREIGN PATENT DOCUMENTS

| | | |
|---|---|---|
| EP | 1284190 | 2/2003 |

* cited by examiner

*Primary Examiner* — Jannelle M Lebron
(74) *Attorney, Agent, or Firm* — Peyton C. Watkins

(57) ABSTRACT

An ink tank including a reservoir for holding ink, the reservoir including a flexible wall for adjusting an internal volume of the reservoir; a biasing element for applying a force to the flexible wall that tends to increase the internal volume of the reservoir; an ink supply port for delivering ink from the reservoir to a printhead; and a breather element, at least a portion of which is disposed inside the reservoir, including a capillary material in contact with ink in the reservoir, wherein the breather element is configured to allow air to enter the reservoir in response to an internal pressure of the reservoir being less than atmospheric pressure outside the ink tank by an amount that is related to a property of the biasing element and a capillary pressure of the breather element.

20 Claims, 18 Drawing Sheets

BIASED WALL INK TANK WITH CAPILLARY BREATHER

CROSS-REFERENCE TO RELATED APPLICATIONS

Reference is made to commonly assigned, co-pending U.S. patent application Ser. No. 12/974,038, filed concurrently herewith, entitled: "Forming an Ink Tank with Capillary Breather", the disclosure of which is incorporated herein.

FIELD OF THE INVENTION

The present invention relates generally to an ink tank for an inkjet printhead, and more particularly to pressure regulation for an ink tank having a spring-biased flexible wall.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to the printhead so that only the ink tank itself needs to be replaced when the ink tank is depleted.

One type of detachable ink tank includes a porous member (also called a wick or scavenger member) at the ink supply port. The printhead inlet port can include a standpipe, for example, with a filter member at its inlet end. When the ink tank is mounted onto the printhead, the ink tank wick is held in contact with the filter member on the standpipe of the printhead inlet port. The ink supply port of the ink tank includes a rim having a face that seals against a gasket surrounding the inlet port of the printhead when the ink tank is installed. The gasket seal provides a substantially airtight ink pathway from the ink tank to the printhead. Once the printhead is primed so that liquid ink fills the various ink passageways between the wick and the nozzles on the printhead, capillary action provides the force necessary to supply the ink to the nozzles as needed for printing. Such an ink tank facilitates easy and clean installation onto the printhead Some types of ink tanks also include capillary media such as felt or foam that is used to retain ink inside the ink tank and provide a slight negative ink pressure so that ink does not drip out of the nozzles of the printhead. This ink-retaining capillary media thus serves as a pressure regulator and provides ink to the wick at the ink supply port.

It has been found that pigment particles in a pigmented ink can settle out in ink tank designs where ink is stored in a capillary media pressure regulator, partly due to the restriction of motion of pigment particles within the small passages of the capillary media, as described in more detail in US Patent Application Publication Number US20090309940. Such settling of pigments particles, especially for larger pigment particles (e.g. larger than 30 nanometers), can result in defective images during the printing process. As a result, an ink tank using capillary media to store ink can lead to a limitation in pigment particle size that can be used. Such a limitation can be disadvantageous because such larger particles can be beneficial for providing higher optical density in printed regions.

A different type of pressure regulator for an ink tank is a bag (or flexible wall) with a spring that provides pressure regulation for a supply of liquid ink within a reservoir of the ink tank. Such ink tanks can have less tendency for settling out of pigment particles than for the case of ink stored in capillary media. In addition, as disclosed in U.S. Pat. No. 7,086,725, an ink tank having a flexible wall or a bag and a spring for pressure regulation can provide ink from the reservoir more efficiently (i.e. less ink trapped in the depleted reservoir) than an ink tank using capillary media ink storage to perform pressure regulation.

In conventional ink tanks having a spring-biased flexible wall, no vent is provided to the ink-filled reservoir. In order to provide pressure regulation for nearly empty reservoirs as well as nearly full reservoirs, it is necessary in such ink tanks for the spring-biased flexible wall to be able to collapse substantially completely in the case of a nearly empty ink reservoir. This requires the flexible wall to have a high degree of flexibility. However, it is also desirable for the flexible wall to have low permeability to air, in order to keep air from passing through the flexible wall and being absorbed into the ink, which can result in air bubbles in the printhead. However, additional layers for low air permeability can reduce the degree of flexibility of the flexible wall. U.S. Pat. No. 6,773,099 discloses an ink tank with a spring-biased flexible wall and a one-way valve to allow air bubbles to enter the reservoir for maintaining a stable negative pressure as ink is used. However, typically such a one-way valve has a substantial cracking pressure at which the valve opens, leading to fluctuations in the regulated pressure, as the negative pressure in the reservoir needs to build up sufficiently to open the one-way valve. U.S. Pat. No. 6,830,324 discloses an air-permeable film provided at one end of an air path to allow air to pass through, but not ink. The air path has an air introduction port in the ink container sized to form an ink meniscus that breaks to allow air into the reservoir when the pressure in the reservoir becomes sufficiently negative. However, it has been found that such an air introduction port would need to have an opening diameter of approximately 50 microns in order to operate satisfactorily for allowing air into the reservoir as described. A difficulty in providing such a small hole in an ink container is that ink containers are typically injection molded, and a 50 micron molding pin to provide such a hole in the container would not be sufficiently robust for injection molding large numbers of ink containers.

What is needed is an ink tank having a spring-biased flexible wall in which air can enter the ink reservoir at a more gradual rate to keep the regulated pressure more uniform. In addition, a method is needed for making such an ink tank in a low cost way that is compatible with high-volume manufacturing methods.

SUMMARY OF THE INVENTION

The present invention is directed to overcoming one or more of the problems set forth above. Briefly summarized, according to one aspect of the invention, the invention resides in an ink tank comprising a reservoir for holding ink, the reservoir including a flexible wall for adjusting an internal volume of the reservoir; a biasing element for applying a force to the flexible wall that tends to increase the internal volume of the reservoir; an ink supply port for delivering ink from the reservoir to a printhead; and a breather element, at least a portion of which is disposed inside the reservoir, including a capillary material in contact with ink in the reservoir, wherein the breather element is configured to allow air to enter the reservoir in response to an internal pressure of the reservoir being less than atmospheric pressure outside the ink tank by an amount that is related to a property of the biasing element and a capillary pressure of the breather element.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
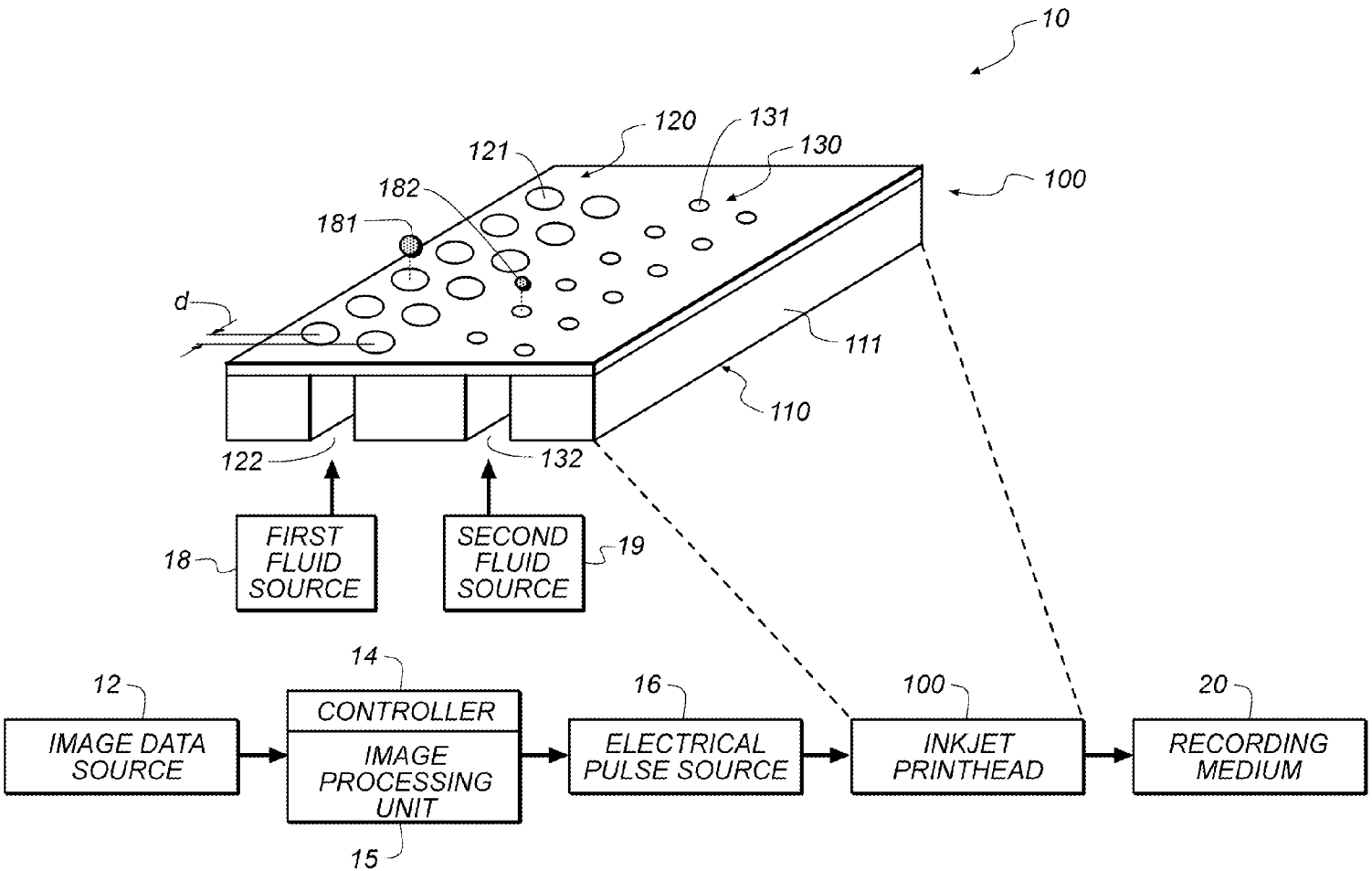
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
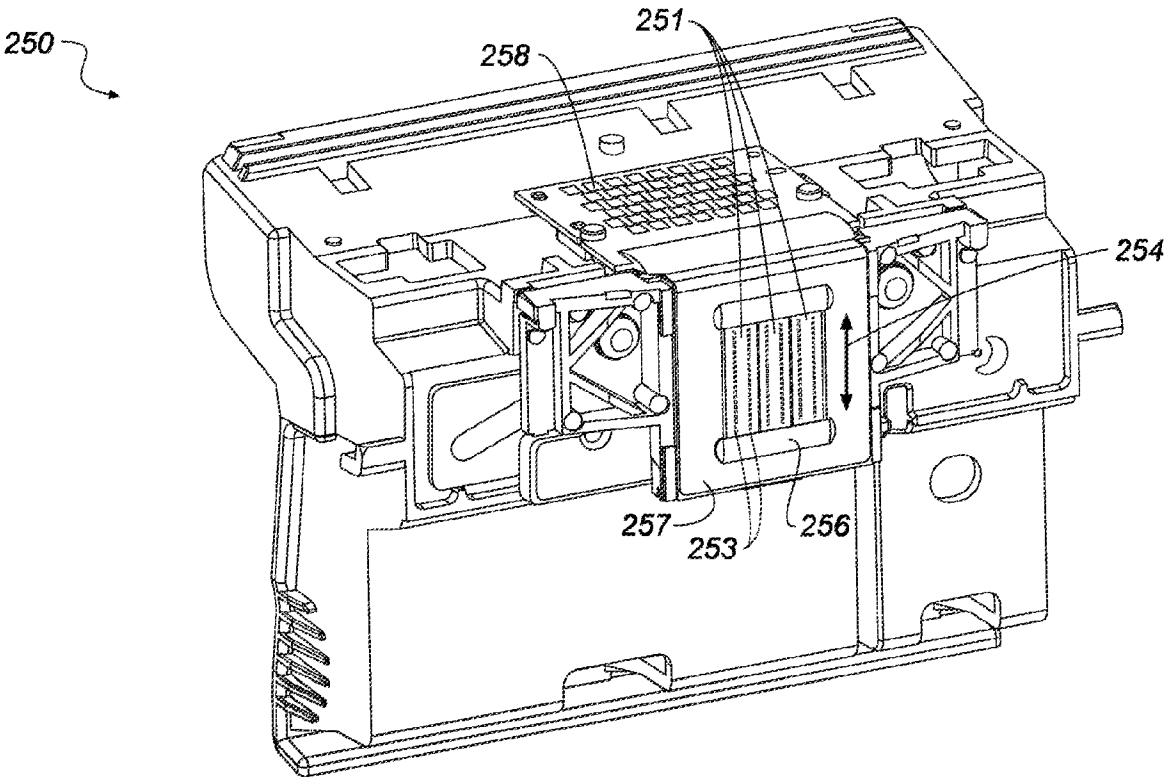
FIG. 2 is a perspective view of a portion of a printhead.

FIG. 2 shows a perspective view of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

Figure 3:
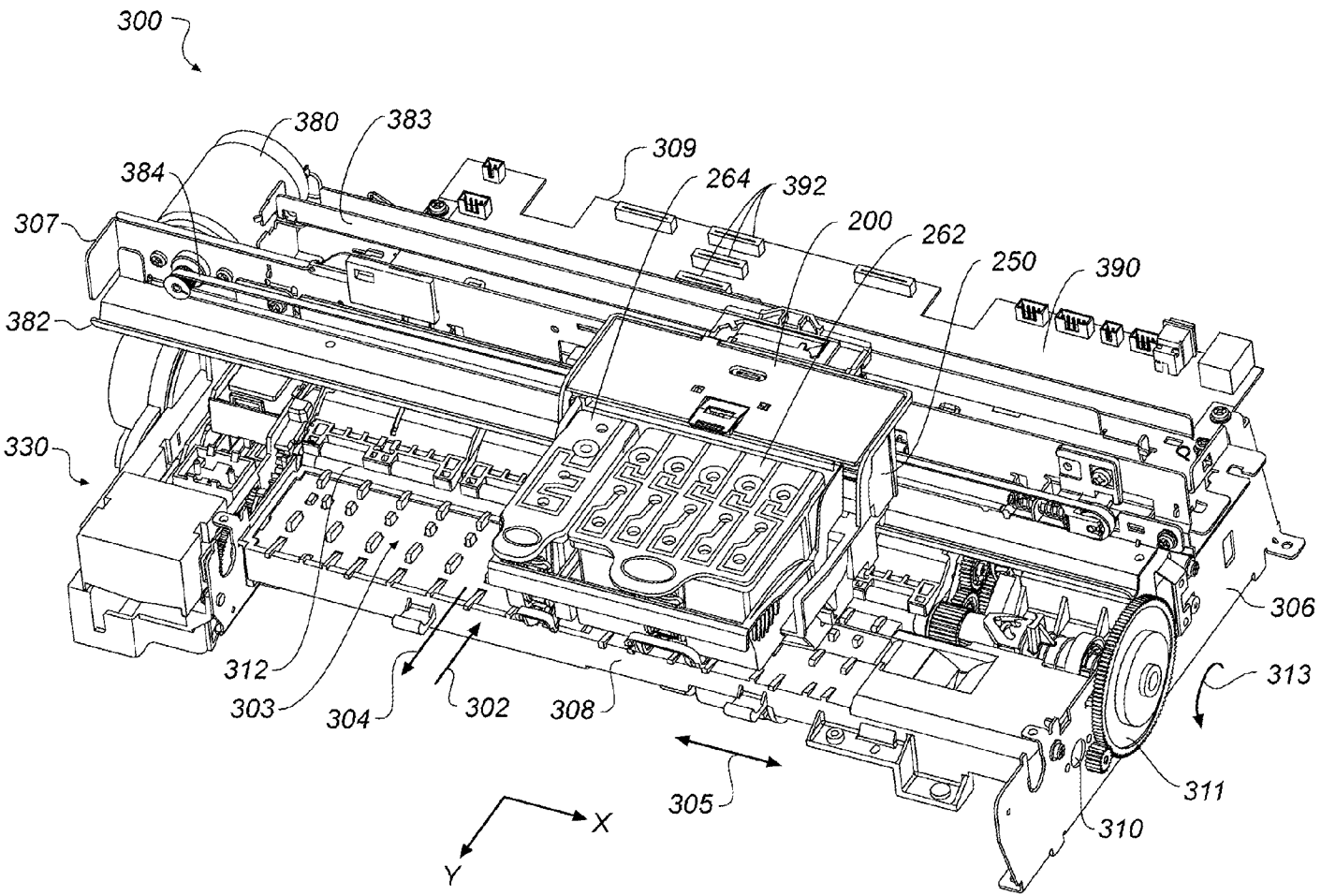
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are installed in the printhead 250. A printhead together with installed ink tanks is sometimes called a printhead assembly. The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. In other embodiments, rather than having a multi-chamber ink tank to hold several ink sources, all ink sources are held in individual single chamber ink tanks. Proper operation of printhead 250 in the inkjet printer requires that the ink tank provide ink to the printhead at a pressure that is regulated to be within a predetermined range of operating pressures as ink is withdrawn for printing operations and/or maintenance operations.

Figure 4:
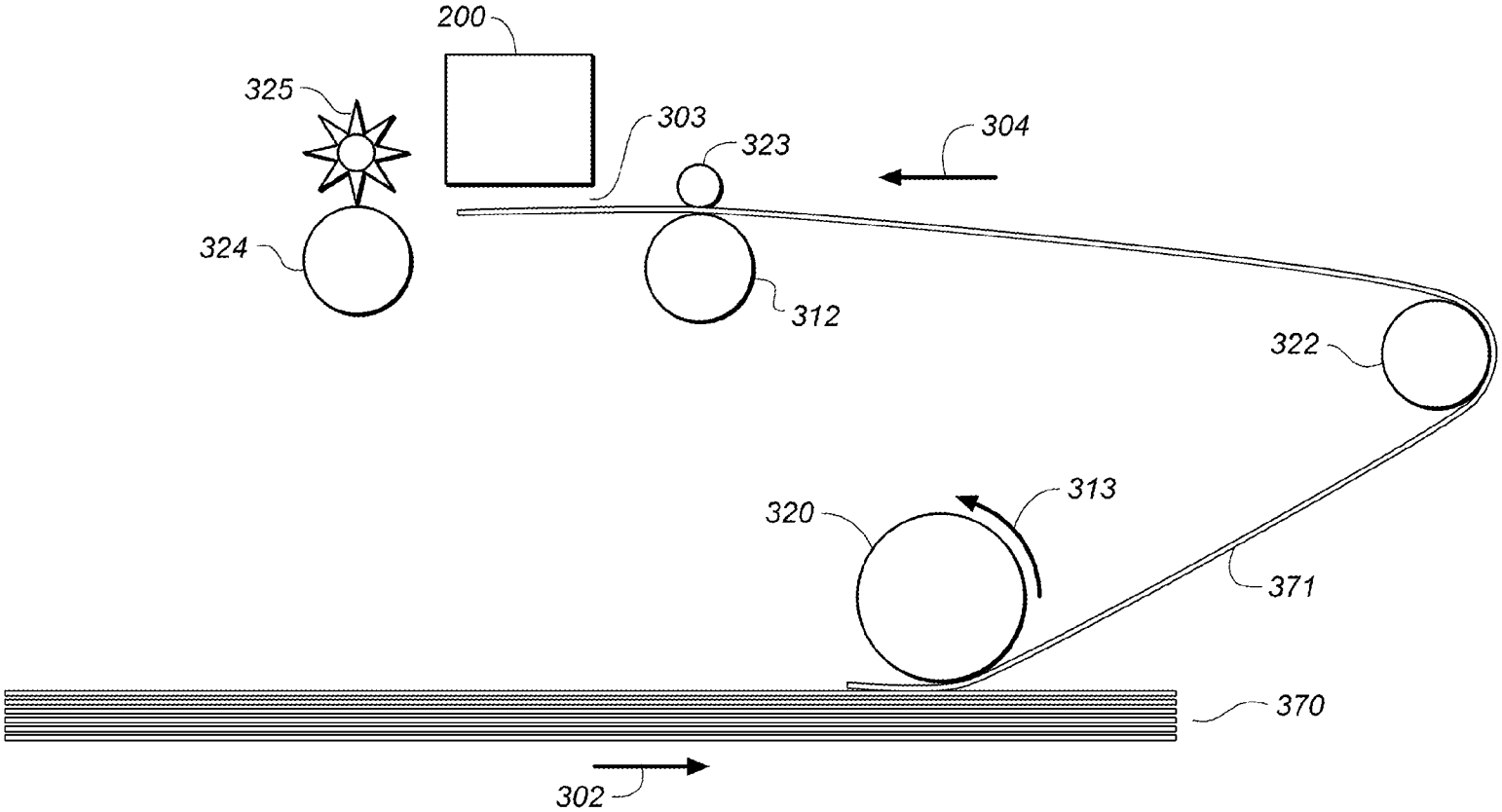
FIG. 4 is a schematic side view of an exemplary paper path in a carriage printer.

Paper or other recording medium (sometimes generically referred to as paper or media herein) is loaded along paper load entry direction 302 toward the front of printer chassis 308. A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
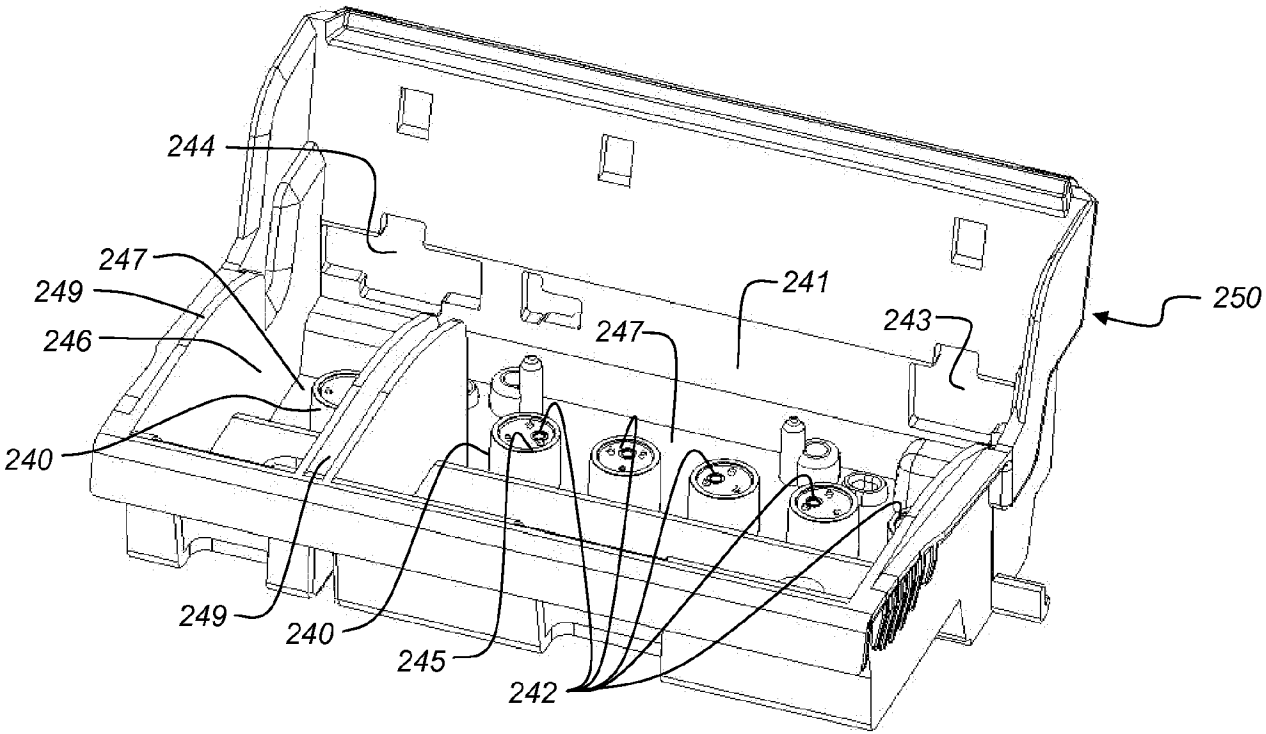
FIG. 5 is a perspective view of a portion of a printhead.

FIG. 5 shows a perspective view of printhead 250 (rotated with respect to the view of FIG. 2) without either replaceable ink tank 262 or 264 mounted onto it. Multi-chamber ink tank 262 is detachably mountable in ink tank holding receptacle 241 and single chamber ink tank 264 is detachably mountable in ink tank holding receptacle 246 of printhead 250. Ink tank holding receptacle 241 is separated from ink tank holding receptacle 246 by a wall 249, which can also help guide the ink tanks during installation. In some embodiments, pedestal 280 (see FIG. 6) of single chamber ink tank 264 is inserted into hole 244 of printhead 250 during mounting of the single chamber ink tank 264. A similar pedestal (not shown) on multi-chamber ink tank 262 is inserted into hole 243 of printhead 250 during mounting of the single chamber ink reservoir 264. Five inlet ports 242 are shown in region 241 that connect with ink supply ports (not shown) of multi-chamber ink tank 262 when it is installed onto printhead 250, and one inlet port 242 is shown in region 246 for the ink supply port 275 (see FIG. 6) on the single chamber ink tank 264. In the example of FIG. 5 each inlet port 242 has the form of a standpipe 240 that extends from the floor of printhead 250. Typically a filter (such as woven or mesh wire filter, not shown) covers the end 245 of the standpipe 240. The diameter of end 245 of standpipe 240 is smaller than that of the opening of ink supply port 275 (see FIG. 6) of ink tank 262 or 264, so that the end 245 of each standpipe 240 is pressed into contact with a corresponding wick 276 at the opening of ink supply port 275. In other words, wick 276 serves as a printhead interface member for the ink tank. On the floor of printhead 250 surrounding standpipes 240 of inlet ports 242 is an elastomeric gasket 247. When an ink tank is installed into the corresponding ink tank holding receptacle 241 or 246 of printhead 250, it is in fluid communication with the printhead because of the connection of the wicks 276 at ink supply ports 272 with the ends 245 of standpipes 240 of inlet ports 242.

Figure 6:
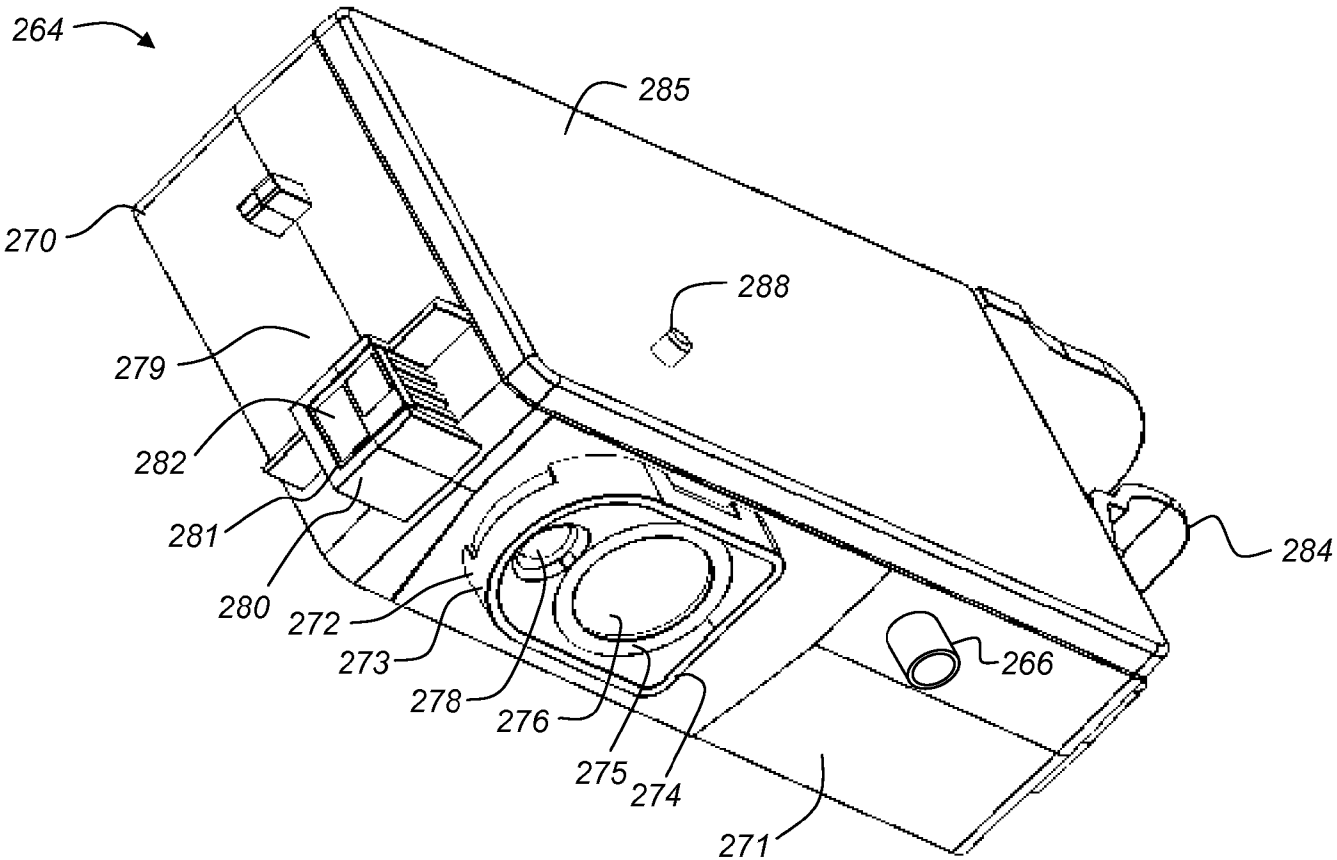
FIGS. 6 and 7 are bottom perspective views of an ink tank according to an embodiment of the invention.
Figure 7:
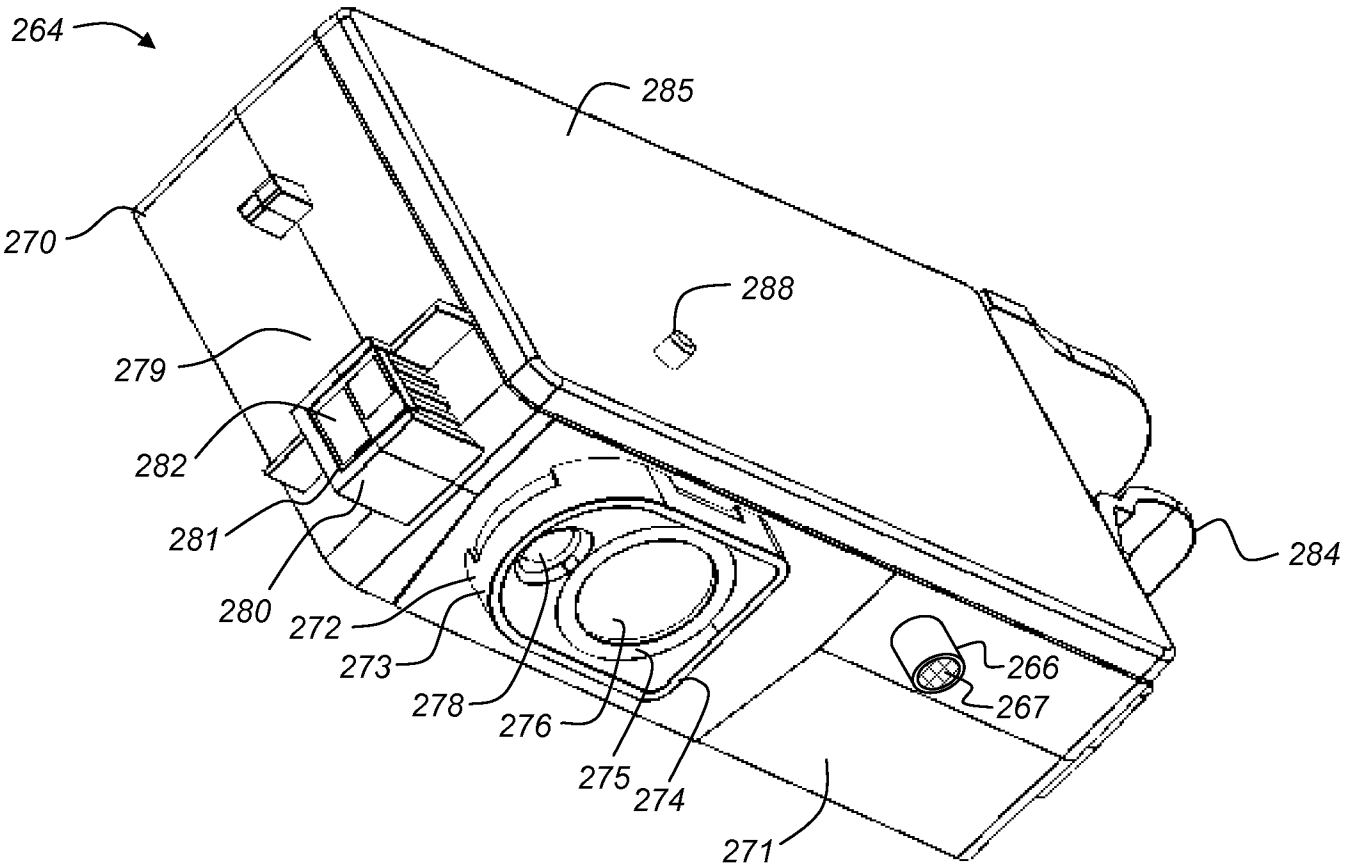
Figure 8:
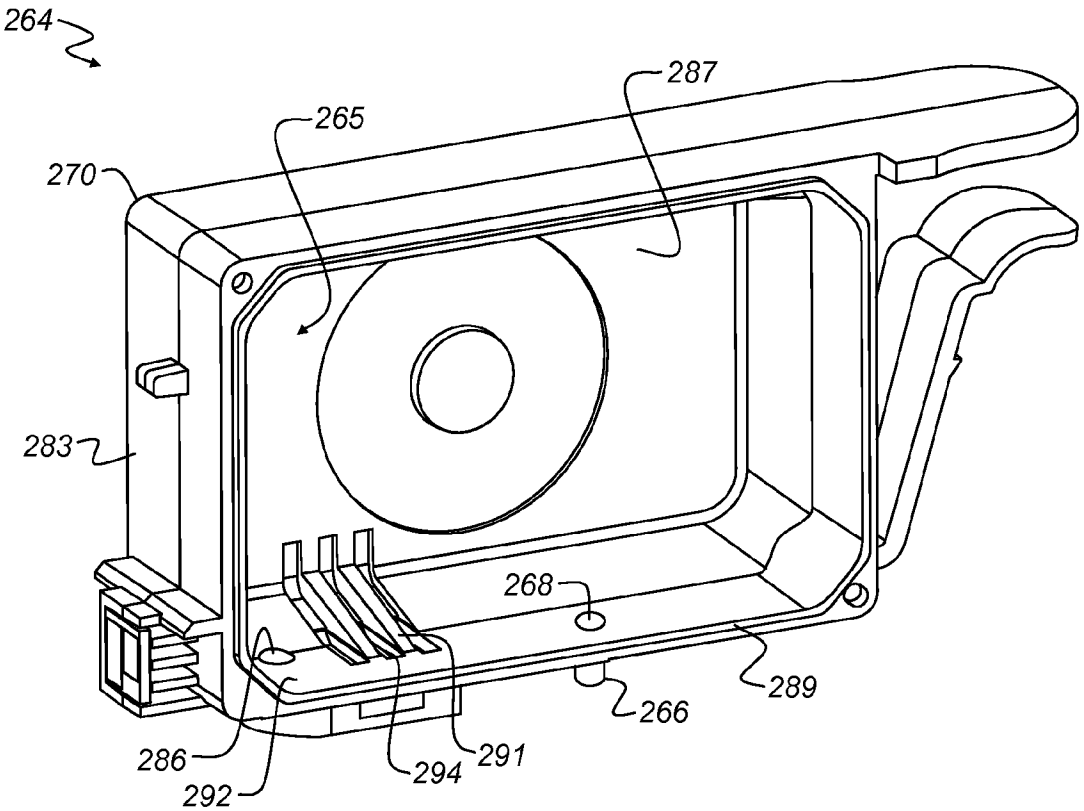
FIG. 8 is a side perspective view of the interior of the housing of the ink tank of FIG. 6.

FIGS. 6 and 7 show bottom perspective views of a single chamber ink tank 264, and FIG. 8 shows a side perspective view of the interior of the housing 270 of ink tank 264 according to an embodiment of the invention. Enclosed within housing 270 of the ink tank is a reservoir 265 (FIG. 8) for holding liquid ink. Extending from a bottom wall 271 of housing 270 is an open-ended tube 266. Inside housing 270 a reservoir end 268 of open-ended tube 266 opens inside the reservoir 265 for liquid ink. As shown in FIG. 7, a capillary member 267 is disposed at or near the outside end of open-ended tube 266. Capillary member 267 can be a porous woven mesh that is welded to the outside end of open-ended tube 266, or it can be a fibrous material or a sintered plastic that is press-fitted into the outside end of open-ended tube 266. Herein, whether the capillary member 267 is welded to the outside end of open-ended tube 266 or is press-fitted into the outside end of open-ended tube 266, it will be said to be affixed to the open-ended tube 266. Together open-ended tube 266 and capillary member 267 are one example of a breather element according to an embodiment of the invention, described in further detail below. The surface of the capillary member 267 that is visible in FIG. 7 is contacted by air from outside housing 270, while the surface of the capillary member 267 that is opposite the side visible in FIG. 7 is contacted by liquid ink when reservoir 265 is filled with ink.

Also as shown in FIG. 6, port member 272 extends from bottom wall 271 of housing 270. Port member 272 has an external rim 273, which is oblong shaped. Rim 273 typically extends outwardly from the housing 270 by one centimeter or less. Enclosed within rim 273 are ink supply port 275 and ink fill port 278, as described in more detail in U.S. patent application Ser. No. 12/642,883, the disclosure of which is incorporated herein in its entirety. In this embodiment, the breather element that includes open-ended tube 266 and capillary member 267 is located near ink supply port 275. Ink fill port 278 need not be enclosed within rim 273. In some embodiments, reservoir 265 can be filled through open-ended tube 266 prior to affixing the capillary member 267. Wick 276 is disposed at the opening of ink supply port 275 for transferring of ink from the reservoir of single chamber ink tank 264 to the corresponding inlet port of printhead 250. Wick 276 is a capillary medium that can be made of a fibrous material (such as a felted material) or a sintered material (such as a sintered plastic) in various embodiments. Rim 273 includes a face 274 that is configured to be sealingly fitted against gasket 247 of printhead 250 (see FIG. 5). Face 274 of rim 273 is pressed into contact with gasket 247 of printhead 250 (see FIG. 5) to form a seal when the ink tank is installed in printhead 250. The seal of face 274 against gasket 247 helps to prevent air leakage into printhead 250, as air bubbles can block the flow of ink in small ink passageways and thereby degrade print quality. A latching lever 284 extends outwardly from housing 270 in order to secure the single chamber ink tank 264 into ink tank holding receptacle 246 when the ink tank is installed in printhead 250.

Figure 9:
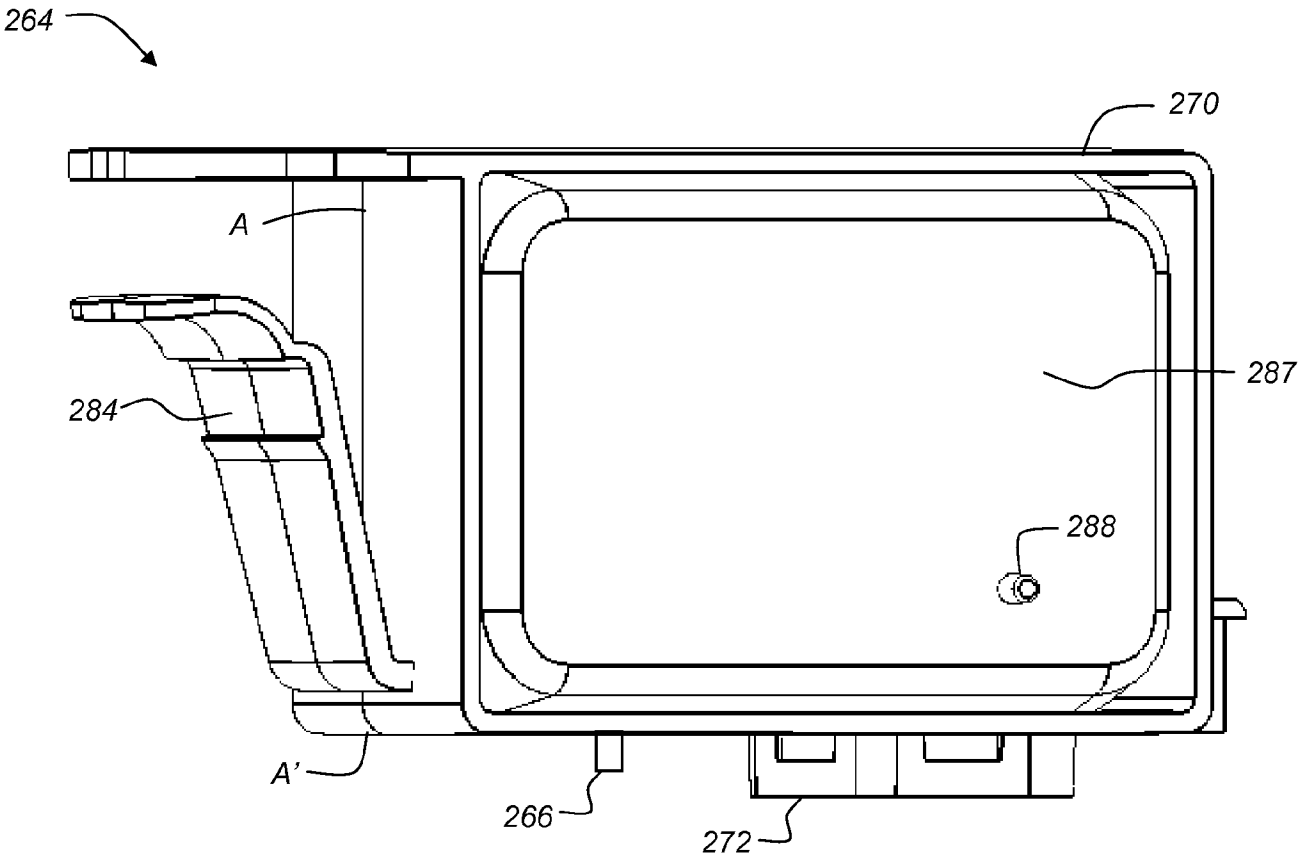
FIG. 9 is side perspective outer view of the back wall of the housing of the ink tank of FIG. 6.

Outer cover 285 is attached to one side of housing 270 (FIG. 7) while rigid back wall 287 (see FIG. 9) on the opposite side is integrally formed with housing 270. Extending outwardly from both outer cover 285 and rigid back wall 287 are protrusions 288 that ride on walls 249 of ink tank holding receptacle 246 (see FIG. 5) during ink tank installation. In some embodiments, a pedestal 280 extends outwardly from a different wall 279 of housing 270 than the wall 271 from which rim 273 extends. Mounted on pedestal 280 is an electrical device 281 including electrical contacts 282. Electrical device 281 can be a memory device or a "smart chip" for storing information about the ink tank and its contents, as well as usage of ink, for example. Alternatively, electrical device 281 can be as simple as a passive circuit with electrical contacts 282 in order to signal to the printer controller 14 that the ink tank has been properly installed in a printhead 250 in carriage 200. Electrical contacts 282 of electrical device 281 make contact with an electrical connector (not shown) on carriage 200, as pedestal 280 extends though hole 243 or 244 in printhead 250 (see FIG. 5).

Figure 10:
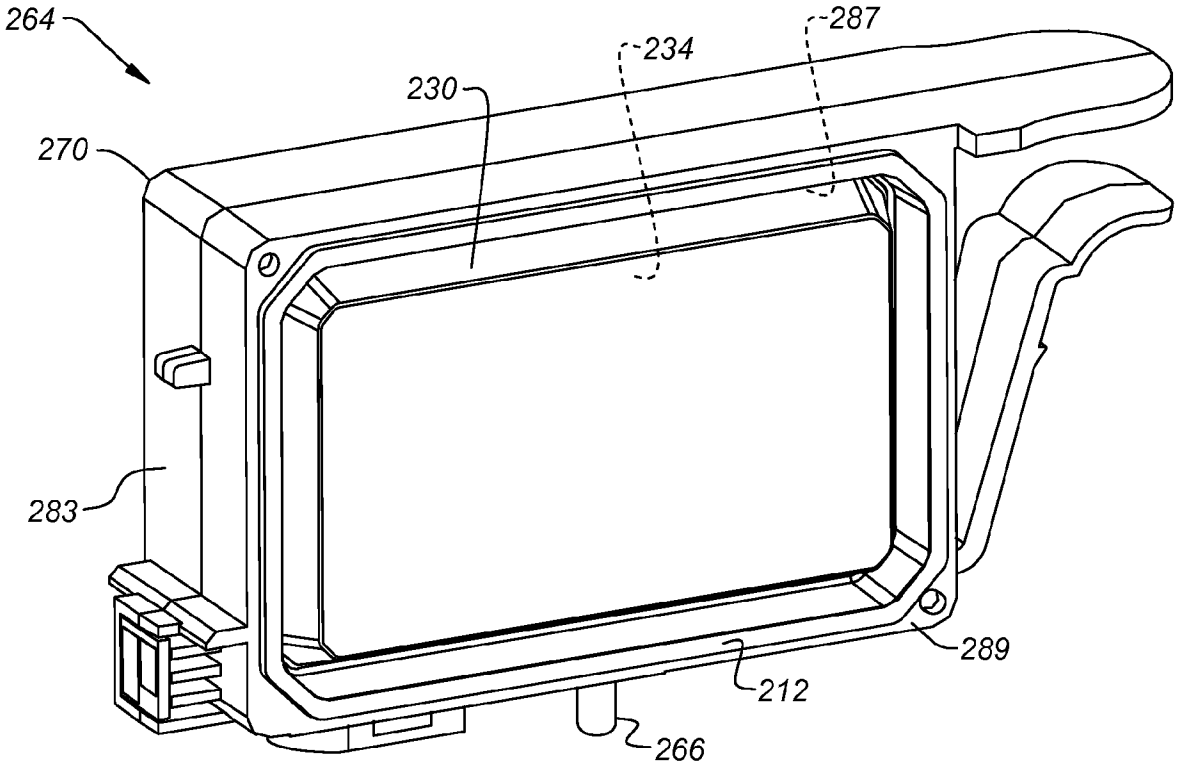
FIG. 10 is a side perspective view after the flexible wall has been added to the housing of FIG. 8.
Figure 11:
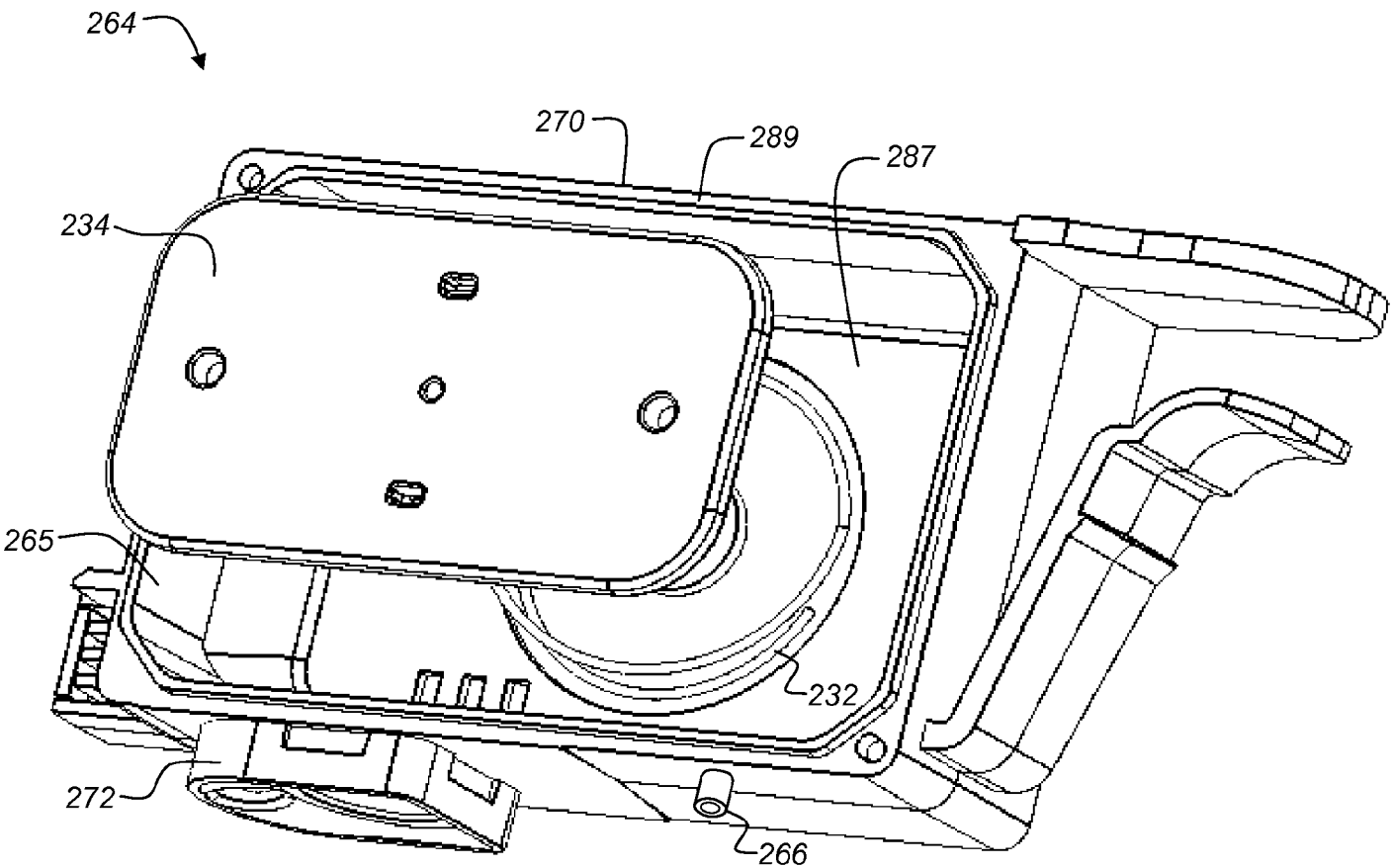
FIG. 11 is a side perspective view of the spring and plate forming a biasing element tending to push the flexible wall of FIG. 8 away from the back wall.

As shown in FIG. 8, housing 270 of single chamber ink tank 264 includes a rigid back wall 287, and a side wall 283 extending around the periphery of back wall 287. Side wall 283 includes walls 271 and 279 described above relative to FIGS. 6 and 7, as well as the walls opposite those walls. Side wall 283 also includes an edge 289. Back wall 287 and side wall 283 form part of an enclosure for a reservoir 265 for ink. A convex-shaped flexible wall 230 (see FIG. 10), is attached and sealed at its periphery to edge 289 of side wall 283 to form the remaining part of the enclosure for reservoir 265. As shown in FIG. 11, spring 232 and plate 234 form a biasing element that applies a biasing force to push a surface of flexible wall 230 outward away from back wall 287. In this example, spring 232 is a coil spring that is located between flexible wall 230 and rigid back wall 287. A first portion of spring 232 is placed in contact with rigid back wall 287 while a second portion of spring 232 is in contact with plate 234 which is in contact with flexible wall 230. In other embodiments, spring 232 and plate 234 can be provided as an integrally formed biasing element for example by punching it from sheet metal. As flexible wall 230 is moved away from or toward back wall 287, the internal volume of reservoir 265 is thereby adjusted to increase or decrease respectively. As shown in FIG. 8, hole 286 is connected to ink fill port 278 and ends flush with interior surface 292 so that reservoir 265 can be filled all the way full with ink. For a conventional spring-biased flexible wall ink tank without a breather element, ribs 291 hold the flexible wall 230 away from interior surface 292 as the flexible wall 230 collapses during depletion of the reservoir so that ink can pass through slots 294 to ink supply port 275 even when the reservoir is nearly empty. Because the flexible wall 232 does not need to collapse against back wall 287 in order to empty ink reservoir 265 in embodiments of this invention, ribs 291 are an optional feature.

Flexible wall 230 and spring 232 plus the breather element that includes capillary member 267 provide pressure regulation to ink enclosed in reservoir 265. In particular, pressure within reservoir 265 decreases as ink is withdrawn for printing or maintenance operations. As a result of the reduced internal pressure within reservoir 265, flexible wall 230 is pulled inward toward back wall 287, compressing spring 232. Once the amount of negative pressure in the reservoir 265 relative to ambient pressure outside the ink tank reaches the capillary pressure of capillary member 267, air from outside the housing 270 enters through capillary member 267 and into reservoir 265. Since the negative pressure in reservoir 287 also depends upon the biasing force of spring 232 (i.e. to the spring constant times the spring displacement), air is allowed into reservoir 265 in response to an internal pressure of the reservoir 265 being less than atmospheric pressure outside the ink tank 264 by an amount that is related to a properties of the spring as well as the capillary pressure of the breather element. Flexible wall 230 remains tautly drawn against plate 234 and is capable of being pushed back outward by the spring 232. After ink withdrawal ceases, pressure changes due to thermal changes or outside barometric changes are buffered by the flexible wall 230 that is biased by spring 232. For a nearly full ink tank, pressure regulation is provided only by the spring-biased flexible wall 230. After enough ink is withdrawn that the capillary pressure of capillary member 267 is reached, pressure regulation is done primarily by air bubble entry through capillary member 267 during ink withdrawal, and by the spring-biased flexible wall 230 at other times. Because the capillary pressure of capillary member 267 is less than the cracking pressure of a typical one-way valve, air can enter the ink reservoir at a more gradual rate through capillary member 267 to keep the regulated pressure more uniform. Fluctuations in pressure are less, relative to the ink tank disclosed in U.S. Pat. No. 6,774,099, thus providing a very stable operating pressure for the printhead. In addition, because air bubbles are allowed to enter reservoir 265 as ink is withdrawn, it is not required that flexible wall 230 be able to collapse entirely toward back wall 287 in order to empty reservoir 265. The decreased requirement of flexibility (since maximum deformation of the wall is reduced) is more compatible with a desirable material choice for flexible wall 230 that has less permeability to air. Requirements on spring 232 are also lessened relative to spring-biased flexible wall ink tanks that do not have a capillary member 267 because the spring does not need to be fully compressed for an empty reservoir 265.

When reservoir 265 is filled to a first internal volume corresponding to a maximum ink fill volume, the flexible wall 230 is located at a first distance from the rigid back wall 287. The spring constant of spring 232 and the capillary pressure of capillary member 267 of the breather element are chosen such that when flexible wall 230 has been displaced to a distance from rigid back wall 287 less than a predetermined second distance that is less than the first distance (the second distance corresponding to a second internal volume less than the first internal volume of reservoir 265), air is allowed into the reservoir 265 through capillary member 267 if the ambient conditions outside the ink tank are at 20 degrees Centigrade and one atmosphere. The precise distance of the flexible wall 230 from the rigid back wall 287 at which pressure in reservoir 265 becomes sufficiently negative so that air is allowed into reservoir 265 through capillary member 267 depends to some extent upon ambient conditions. For example, if the ambient air pressure is greater than one atmosphere, air will enter through capillary member 267 when the flexible wall has been displaced to a distance from the back wall that is correspondingly greater than the predetermined second distance. Also if the ambient conditions cause the ink temperature to be greater or less than 20 degrees Centigrade, thermal expansion effects can change the distance of the flexible wall 230 from the back wall 287 at which air will enter through capillary member 267. However, if the flexible wall 230 is located at a distance from the rigid back wall 287 that is greater than or equal to the second distance (i.e. for reservoir internal volumes that are greater than or equal to the second internal volume), no air is allowed into reservoir 265, if the ambient conditions outside the ink tank are at 20 degrees Centigrade and one atmosphere. Typically, the second distance is between about 80% and 95% of the first distance. Similarly, the second internal volume is typically between 80% and 95% of the first internal volume of the reservoir 265 corresponding to the maximum ink fill volume.

Figure 12:
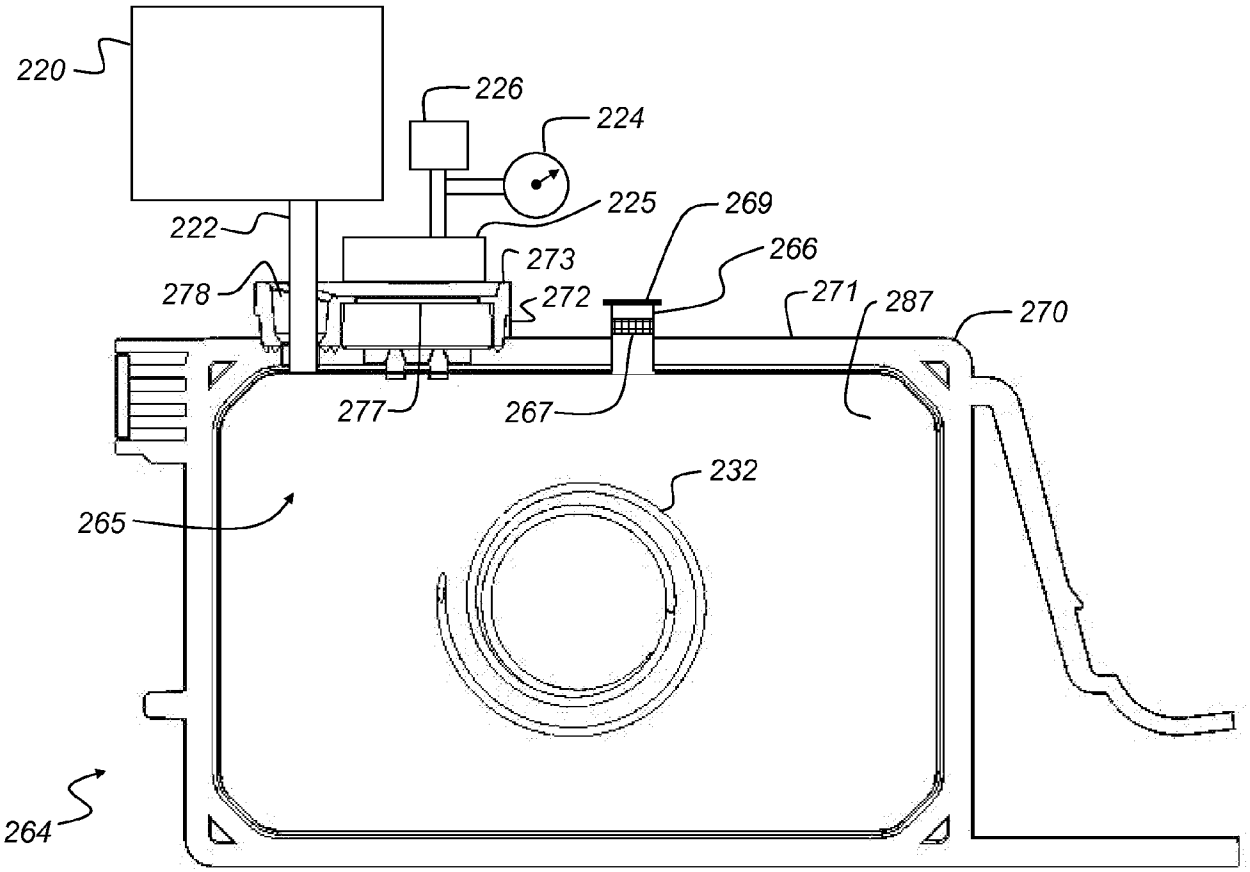
FIG. 12 is a cross-sectional view of the ink tank of FIG. 6, illustrating a method of filling the ink tank.
Figure 13:
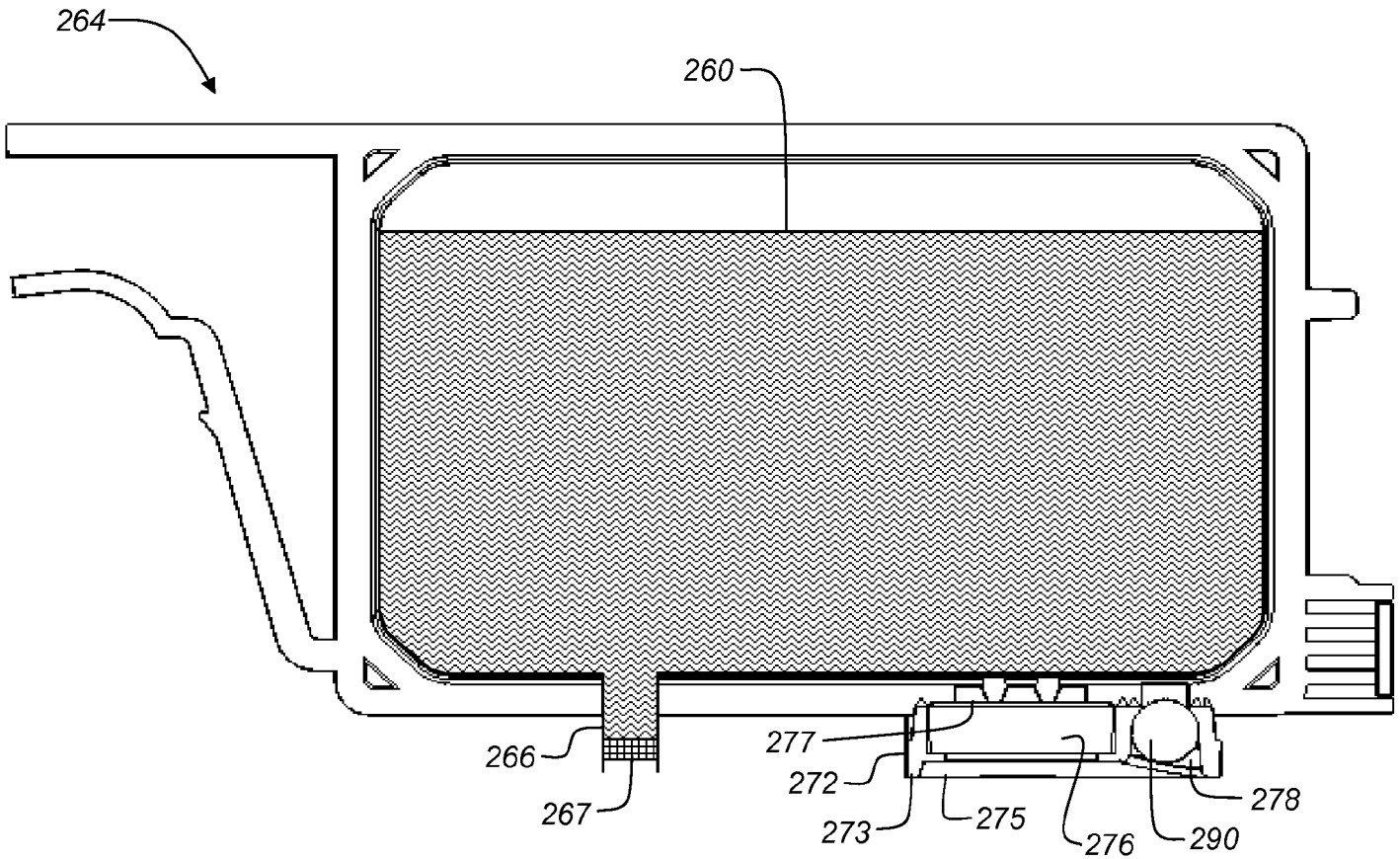
FIG. 13 is a cross-sectional view of the ink tank of FIG. 6 after the reservoir has been filled with ink.

A method of filling single chamber ink tank 264 with ink is shown schematically in FIG. 12 (including a cross-sectional view through A-A' of FIG. 9), with port member 272 facing upward. Open-ended tube 266 is blocked off by stopper 269. Air is removed from reservoir 265 by vacuum source 226, thereby drawing flexible wall 230 partway toward back wall 287. In some embodiments a coupling connection 225 is fitted over ink supply port 275 to connect the vacuum source 226. Optionally a pressure gauge 224 is used to monitor pressure while vacuum source 226 pulls out the air at this step. Ink fill port 278 is configured to receive an ink fill tube 222 that is connected to ink source 220. As ink flows into reservoir 265 from ink source 220 through ink fill tube 222, flexible wall 230 tends to expand outwardly away from rigid back wall 287. When the ink fill process is completed and liquid ink has been provided to the reservoir, a plug 290, configured to seal ink fill port 278, is inserted into ink fill port 278, as shown in FIG. 13. Plug 290 can be a compliant ball, for example, and can be press fitted into ink fill port 278. Note in FIG. 13 that liquid ink 260 in reservoir 265 is in contact with one surface of capillary member 267 in open-ended tube 266, while air from outside housing 270 is in contact with the opposite surface of capillary member 267. Outer cover 285 (FIG. 7) is affixed to housing 270 opposite back wall 287 such that plate 234, spring 232 and flexible wall 230 are between outer cover 285 and rigid back wall 287 in order to provide protection for flexible wall 230 and ink reservoir 265.

Figure 14:
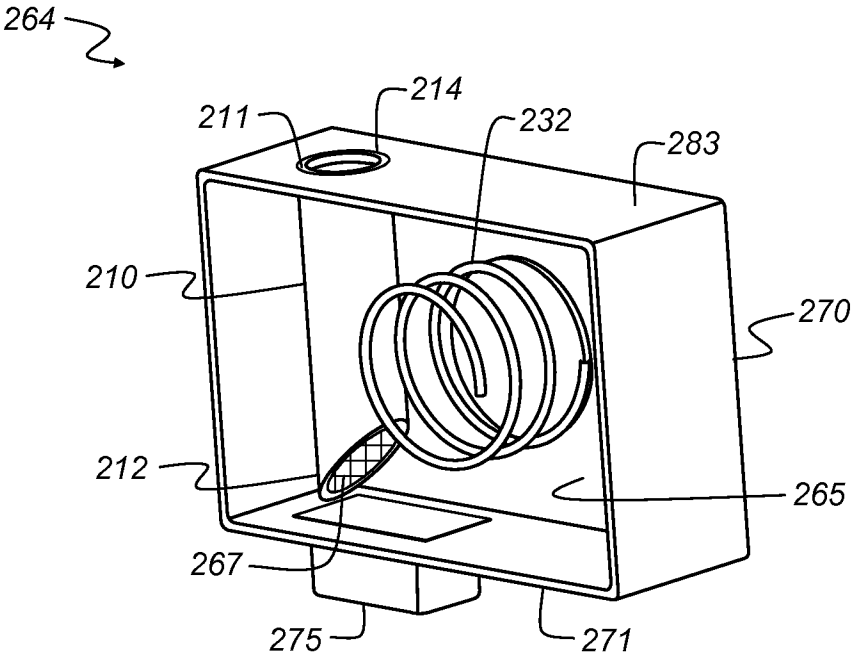
FIG. 14 is side perspective view of the interior of the housing of an ink tank having a capillary element on a snorkel pipe with angled end according to an embodiment of the invention.
Figure 15:
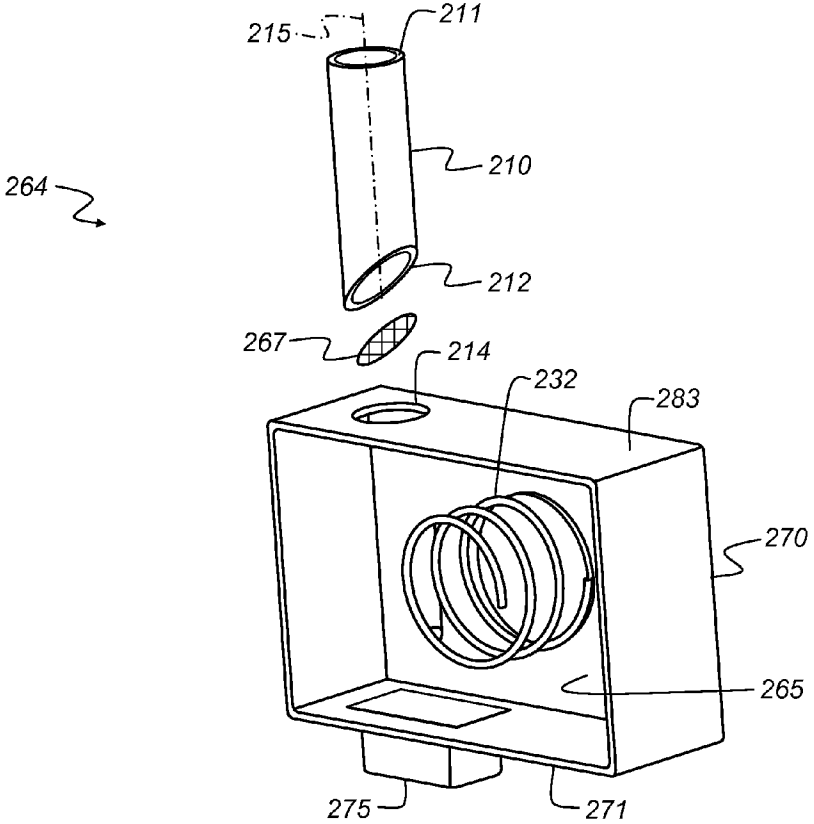
FIG. 15 is an exploded view of the ink tank of FIG. 14.

FIG. 14 shows an interior perspective view and FIG. 15 shows an exploded view of a portion of an ink tank 264 according to another embodiment of the invention. In this embodiment the breather element includes capillary member 267 that is affixed to an end 212 of a pipe 210 that functions as a snorkel having a first end 211 open to air outside housing 270 and a second end 212 in contact with liquid ink in reservoir 265. In this embodiment, housing 270 includes an opening 214 in side wall 283, typically on the wall that is positioned facing upward when the ink tank 264 is in its operating position. Like housing 270, pipe 210 is typically injection molded. For the case where capillary member 267 is a woven mesh as in FIGS. 14 and 15, capillary member 267 can be affixed to second end 212 of pipe 210 by welding, for example by heat staking. For the case where capillary member 267 is a porous material such as a fibrous material, as shown in the exploded view of FIG. 16, capillary member 267 can be affixed to the second end 212 of pipe 210 by inserting it into second end 212. Second end 212 of pipe 210 can then be inserted into opening 214 in sidewall 283 of housing 270 and pushed in until first end 211 is near opening 214. Then pipe 210 can be affixed to housing 270 at or near first end 211. Affixing of pipe 210 can be done using an adhesive or by welding. Ultrasonic welding, vibration welding or spin welding are examples of ways that the pipe 210 can be affixed to housing 270. First end 211 of pipe 210 is configured to be above ink supply port 275 (though not necessarily directly above) when the ink tank 264 is mounted in its operating orientation in a printer (FIG. 3). Second end 212 of pipe 210 is configured to be near bottom wall 271 of housing 270, so that pressure regulation can be provided through capillary member 267 in contact with ink until the ink tank 264 is substantially empty.

Figure 16:
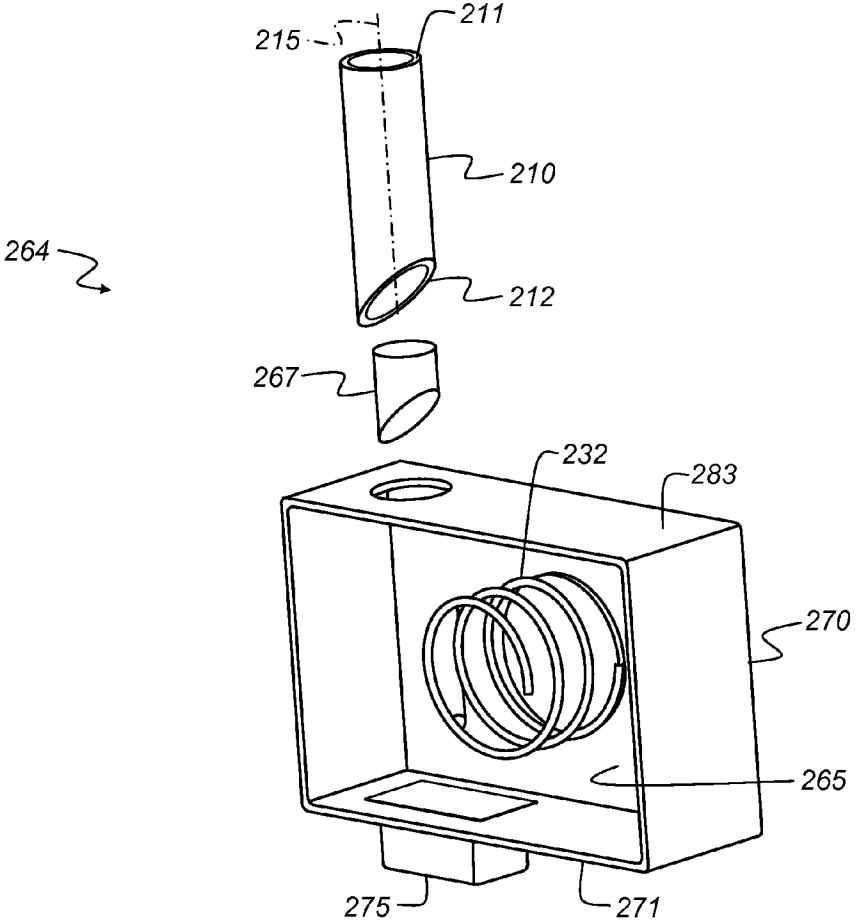
FIG. 16 is an exploded view similar to FIG. 15 where the capillary element is inserted into the angled end of the snorkel pipe.

In some embodiments as shown in FIGS. 14-16, the second end 212 is formed to be angled with respect to the length axis 215 of the pipe 210 so that second end 212 is not perpendicular to the length axis 215 of pipe 210. Then when the pipe 210 is affixed to the housing 270 and the ink tank 264 is in its operating position, second end 212 is inclined upward rather than being horizontal. Such an inclined configuration can be preferred for facilitating removal of air bubbles by buoyancy so that air bubbles on the ink-contacting surface are less likely to impede flow of air through capillary member 267.

Figure 17:
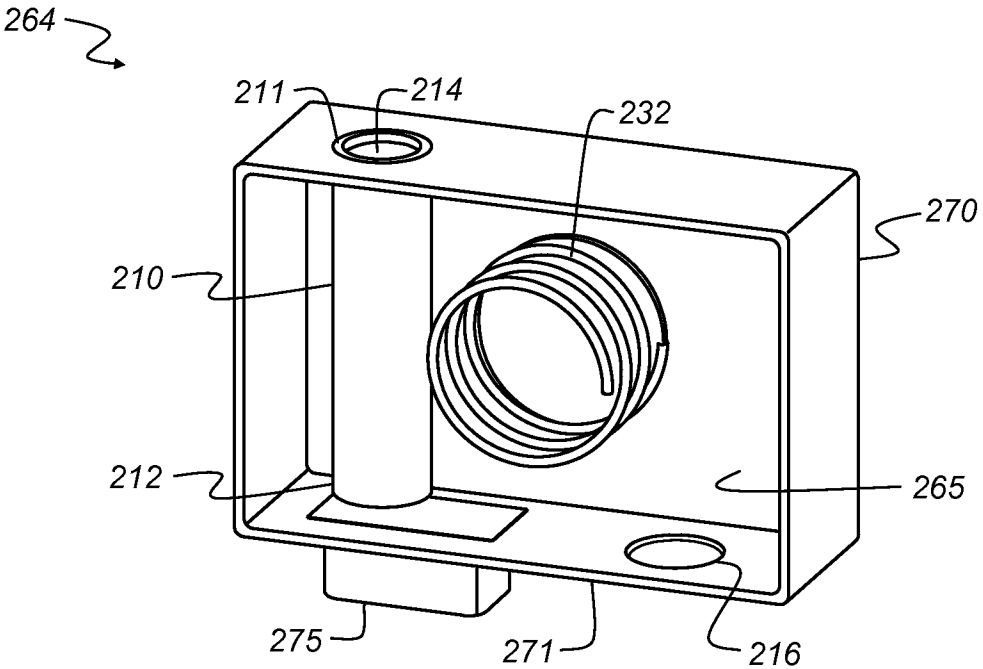
FIG. 17 is a side perspective view of similar to FIG. 14 for an embodiment where the end of the snorkel pipe is not angled.
Figure 18:
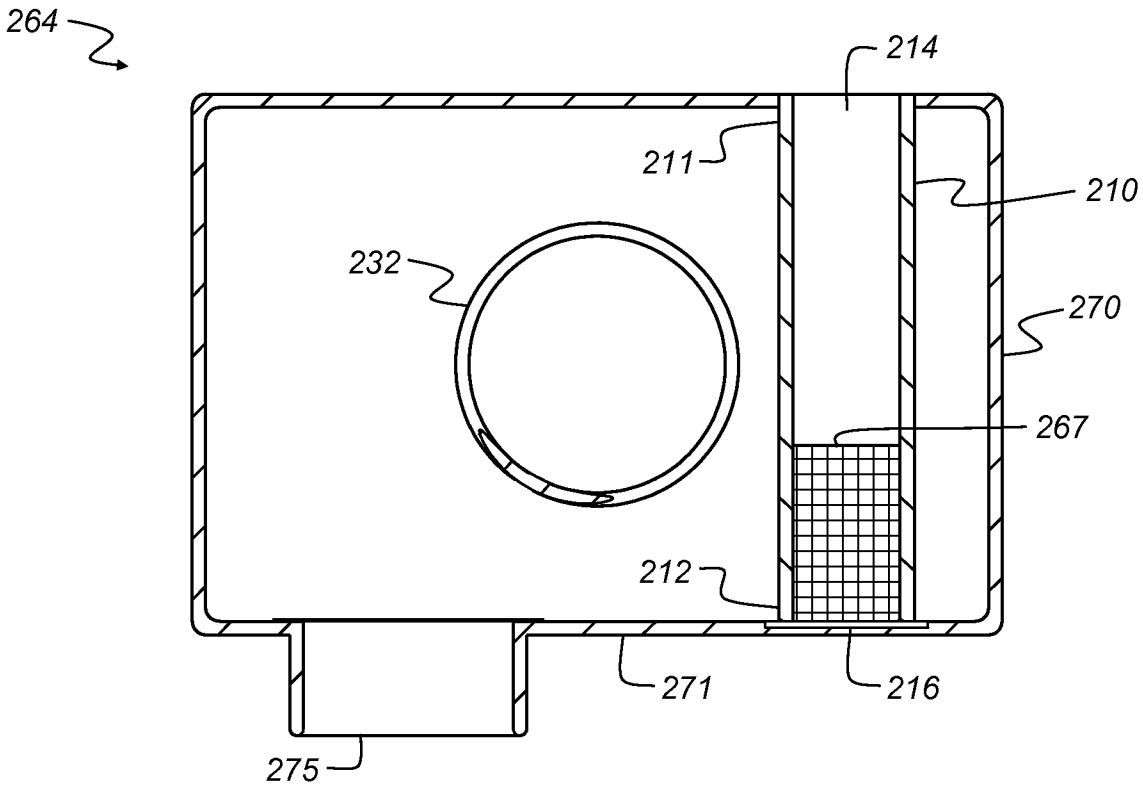
FIG. 18 is a cross-sectional view for an embodiment where the snorkel pipe is located over a depression in the bottom wall of the ink tank housing.

In other embodiments as shown in FIG. 17, the second end 212 is formed to be substantially perpendicular to the length axis of pipe 210, such that second end 212 is substantially parallel to bottom wall 271 of housing 270. To facilitate allowing pressure regulation until the ink tank 264 is nearly empty, it is advantageous for second end 212 of pipe 210 to be close to the bottom wall 271 of housing 270 while still allowing entry of air into reservoir 265 through capillary member 267. In some embodiments a depression 216 is provided in bottom wall 271. As shown in the cross-sectional drawing of FIG. 18, second end 212 of pipe 210 can be located next to depression 216 such that the capillary member 267 can be in contact with ink until the in tank 264 is substantially empty.

Flexible wall 230 can be formed into a convex shape by thermo-forming a flat piece of plastic film stock into the desired shape, conforming the plastic around a member having the desired shape and applying heat. In addition to a bondable layer (such as a weldable layer of polyethylene) to be adhered to the edge 289 of side wall 283 of housing 270, flexible wall 230 can also include an oxygen-transmission-resistant barrier layer of nylon or EVOH (ethylene vinyl alcohol) that is not placed into contact with edge 289.

As in the example of the previous embodiment shown in FIG. 11, the biasing element can include a coil spring 232. A first portion of spring 232 is placed in contact with rigid back wall 287 while a second portion of spring 232 is in contact with plate 234 which is in contact with flexible wall 230. A peripheral bonding region of flexible wall 230 is affixed to an edge 289 of side wall 283 to form a reservoir for holding ink. Second end 212 of pipe 210 is located in reservoir 265 between flexible wall 230 and back wall 287. Air is then removed from reservoir 265 as discussed above relative to FIG. 12 so that flexible wall 230 is drawn toward back wall 287 against the spring force of spring 232. Liquid ink is then added to the reservoir such that the liquid ink contacts the surface of capillary member 267 that faces into ink reservoir 265. The opposite surface of capillary member 267 is in contact with air outside housing 270 through the first end 211 of pipe 210.

In some embodiments a second capillary member, such as porous wick 276 is provided at ink supply port 275, e.g. by inserting wick 276 into ink supply port 275. When the ink tank 264 is assembled onto printhead 250, wick 276 transfers ink from ink supply port 276 to inlet pipe 242 of printhead 250, as described above with reference to FIG. 5. In some embodiments a screen 277, also sometimes called a woven mesh herein, is attached to an inner portion of the ink supply port, as described in further detail in U.S. patent application Ser. No. 12/642,883. In such an embodiment, a function of mesh screen 277 is to control the passage of air through ink supply port 275. When screen 277 is wetted by ink, air is unable to pass through freely, so that a suitable negative pressure can be maintained in reservoir 265. Attachment of the woven mesh can be done by heat staking. Outer cover 285 is affixed to housing 270 opposite back wall 287 in order to protect flexible wall 230 of reservoir 265.

The invention has been described in detail with particular reference to certain preferred embodiments thereof, but it will be understood that variations and modifications can be effected within the spirit and scope of the invention.

PARTS LIST

| | |
|---|---|
| 10 | Inkjet printer system |
| 12 | Image data source |
| 14 | Controller |
| 15 | Image processing unit |
| 16 | Electrical pulse source |
| 18 | First fluid source |
| 19 | Second fluid source |
| 20 | Recording medium |
| 100 | Inkjet printhead |
| 110 | Inkjet printhead die |
| 111 | Substrate |
| 120 | First nozzle array |
| 121 | Nozzle(s) |
| 122 | Ink delivery pathway (for first nozzle array) |
| 130 | Second nozzle array |
| 131 | Nozzle(s) |
| 132 | Ink delivery pathway (for second nozzle array) |
| 181 | Droplet(s) (ejected from first nozzle array) |
| 182 | Droplet(s) (ejected from second nozzle array) |
| 200 | Carriage |
| 210 | Pipe |
| 211 | First end (of pipe) |
| 212 | Second end (of pipe) |
| 214 | Opening (in housing) |
| 215 | Length axis (of pipe) |
| 216 | Depression |
| 220 | Ink source |
| 222 | Ink fill tube |
| 224 | Pressure gauge |
| 225 | Coupling connection |
| 226 | Vacuum source |
| 230 | Flexible wall |
| 232 | Spring |
| 234 | Plate |
| 240 | Standpipe |
| 241 | Region (for mounting multi-chamber ink tank) |
| 242 | Inlet port |
| 243 | Hole |
| 244 | Hole |
| 245 | End |
| 246 | Region (for mounting single chamber ink tank) |
| 247 | Gasket |
| 249 | Wall |
| 250 | Printhead |
| 251 | Printhead die |
| 253 | Nozzle array |
| 254 | Nozzle array direction |
| 256 | Encapsulant |
| 257 | Flex circuit |
| 258 | Connector board |
| 260 | Ink |
| 262 | Multi-chamber ink tank |
| 264 | Single-chamber ink tank |
| 265 | Reservoir |
| 266 | Open-ended tube |
| 267 | Capillary member |
| 268 | Reservoir end (of open-ended tube) |
| 269 | Stopper |
| 270 | Housing |
| 271 | Wall |
| 272 | Port member |
| 273 | Rim |
| 274 | Face |
| 275 | Ink supply port |
| 276 | Wick |
| 277 | Screen |
| 278 | Ink fill port |
| 279 | Wall |
| 280 | Pedestal |
| 281 | Electrical device |
| 282 | Electrical contacts |
| 283 | Side wall |

-continued

| PARTS LIST | |
|---|---|
| 284 | Latching lever |
| 285 | Outer cover |
| 286 | Hole |
| 287 | Back wall |
| 288 | Protrusion |
| 289 | Edge (of side wall) |
| 290 | Plug |
| 291 | Ribs |
| 292 | Interior surface |
| 294 | Ink slots |
| 300 | Printer chassis |
| 302 | Paper load entry direction |
| 303 | Print region |
| 304 | Media advance direction |
| 305 | Carriage scan direction |
| 306 | Right side of printer chassis |
| 307 | Left side of printer chassis |
| 308 | Front of printer chassis |
| 309 | Rear of printer chassis |
| 310 | Hole (for paper advance motor drive gear) |
| 311 | Feed roller gear |
| 312 | Feed roller |
| 313 | Forward rotation direction (of feed roller) |
| 320 | Pick-up roller |
| 322 | Turn roller |
| 323 | Idler roller |
| 324 | Discharge roller |
| 325 | Star wheel(s) |
| 330 | Maintenance station |
| 370 | Stack of media |
| 371 | Top piece of medium |
| 380 | Carriage motor |
| 382 | Carriage guide rail |
| 383 | Encoder fence |
| 384 | Belt |
| 390 | Printer electronics board |
| 392 | Cable connectors |

The invention claimed is:

1. An ink tank comprising:

a reservoir for holding ink, the reservoir including a flexible wall for adjusting an internal volume of the reservoir;

a biasing element for applying a force to the flexible wall that tends to increase the internal volume of the reservoir;

an ink supply port for delivering ink from the reservoir to a printhead;

a breather element, at least a portion of which is disposed inside the reservoir so that a first end is open to air and a second end is in contact with the ink, including a capillary material in contact with the ink in the reservoir, wherein the breather element permits air to enter the reservoir in response to an internal pressure of the reservoir being less than atmospheric pressure outside the ink tank by an amount that is related to a property of the biasing element and a capillary pressure of the breather element; and a housing; wherein the breather element comprises a pipe having the first end that opens to air outside the housing of the ink tank and the second end that is inside the reservoir that holds the ink; and a capillary element affixed to the second end of the pipe.

2. The ink tank of claim 1, wherein the biasing element comprises a spring, and wherein the property of biasing element is a spring constant that relates a displacement of the spring to a restoring force of the spring.

3. The ink tank of claim 1, wherein the capillary material comprises a porous mesh.

4. The ink tank of claim 1, wherein the capillary material comprises a fibrous material.

5. The ink tank of claim 1, wherein the capillary material comprises a sintered plastic.

6. The ink tank of claim 1, wherein the breather element is disposed proximate the ink supply port.

7. The ink tank of claim 1, wherein the first end of the pipe is configured to be above the ink supply port when the ink tank is mounted in its operating orientation in a printer.

8. The ink tank of claim 1, wherein the pipe having an axis along its length, and wherein the second end of the pipe is not perpendicular to the axis of the pipe.

9. The ink tank of claim 1 further comprising a bottom wall including a depression, wherein the depression is located proximate the second end of the pipe.

10. The ink tank of claim 1, wherein the reservoir further includes a rigid wall that is opposite the flexible wall, and wherein a periphery of the flexible wall is sealed to a side wall that extends from the rigid wall.

11. The ink tank of claim 10, wherein the biasing element is disposed between the flexible wall and the rigid wall.

12. The ink tank of claim 10, wherein a first portion of the biasing element is in contact with the rigid wall and a second portion of the biasing element is in contact with the flexible wall.

13. The ink tank of claim 10 further comprising a cover, wherein the flexible wall is disposed between the cover and the rigid wall.

14. The ink tank of claim 10, the reservoir including:

a first distance between the rigid wall and the flexible wall corresponding to a maximum ink fill volume; and a second distance between the rigid wall and the flexible wall that is less than the first distance, wherein the property of the biasing element and the capillary pressure of the breather element are configured not to allow air into the reservoir when a distance between the rigid wall and the flexible wall of the reservoir is greater than or equal to the second distance at ambient conditions of 20 degrees Centigrade and one atmosphere.

15. The ink tank of claim 14, wherein the property of the biasing element and the capillary pressure of the breather element are configured to allow air into the reservoir when a distance between the rigid wall and the flexible wall of the reservoir is less than the second distance at ambient conditions of 20 degrees Centigrade and one atmosphere.

16. The ink tank of claim 14, wherein the second distance is between 80% and 95% of the first distance between the rigid wall and the flexible wall of the reservoir.

17. The ink tank of claim 1, the reservoir further including:

a first internal volume corresponding to a maximum ink fill volume; and a second internal volume less than the first internal volume, wherein the property of the biasing element and the capillary pressure of the breather element are configured not to allow air into the reservoir when the internal volume of the reservoir is greater than or equal to the second internal volume at ambient conditions of 20 degrees Centigrade and one atmosphere.

18. The ink tank of claim 17, wherein the property of the biasing element and the capillary pressure of the breather element are configured to allow air into the reservoir when the internal volume of the reservoir is less than the second internal volume at ambient conditions of 20 degrees Centigrade and one atmosphere.

19. The ink tank of claim 17, wherein the second internal volume is between 80% and 95% of the first internal volume of the reservoir.

20. An inkjet printer including an ink tank for providing ink to a printhead at a pressure that is regulated to be within a predetermined range of operating pressures as ink is withdrawn for printing operations, the ink tank comprising:

a reservoir for holding ink, the reservoir including a flexible wall for adjusting an internal volume of the reservoir;

a biasing element for applying a force to the flexible wall that tends to increase the internal volume of the reservoir;

an ink supply port for delivering ink from the reservoir to the printhead;

a breather element, at least a portion of which is disposed inside the reservoir so that a first end is open to air and a second end is in contact with the ink, including a capillary material in contact with the ink in the reservoir, wherein the breather element permits air to enter the reservoir in response to an internal pressure of the reservoir being less than atmospheric pressure outside the ink tank by an amount that is related to a property of the biasing element and a capillary pressure of the breather element, and a housing; wherein the breather element comprises a pipe having the first end that opens to air outside the housing of the ink tank and the second end that is inside the reservoir that holds the ink; and a capillary element affixed to the second end of the pipe.

* * * * *